US010273555B2

(12) United States Patent
Hayashi

(10) Patent No.: US 10,273,555 B2
(45) Date of Patent: Apr. 30, 2019

(54) HOT-PRESSED STEEL SHEET MEMBER

(71) Applicant: NIPPON STEEL & SUMITOMO METAL CORPORATION, Tokyo (JP)

(72) Inventor: Koutarou Hayashi, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 239 days.

(21) Appl. No.: 15/101,772

(22) PCT Filed: Dec. 27, 2013

(86) PCT No.: PCT/JP2013/085167
§ 371 (c)(1),
(2) Date: Jun. 3, 2016

(87) PCT Pub. No.: WO2015/097882
PCT Pub. Date: Jul. 2, 2015

(65) Prior Publication Data

US 2017/0029915 A1 Feb. 2, 2017

(51) Int. Cl.

| | |
|---|---|
| ***C22C 38/02*** | (2006.01) |
| ***C22C 38/04*** | (2006.01) |
| ***C22C 38/06*** | (2006.01) |
| ***C21D 9/48*** | (2006.01) |
| ***B21D 22/02*** | (2006.01) |
| ***C21D 9/46*** | (2006.01) |
| ***C21D 9/00*** | (2006.01) |
| ***C21D 1/18*** | (2006.01) |
| ***C22C 38/00*** | (2006.01) |
| ***C22C 38/58*** | (2006.01) |
| ***C22C 38/08*** | (2006.01) |
| ***C22C 38/12*** | (2006.01) |
| ***C22C 38/14*** | (2006.01) |
| ***C22C 38/16*** | (2006.01) |
| ***C22C 38/38*** | (2006.01) |
| ***C21D 3/04*** | (2006.01) |
| ***C21D 8/04*** | (2006.01) |
| ***C21D 1/673*** | (2006.01) |

(52) U.S. Cl.

CPC ..... *C21D 9/46* (2013.01); *C21D 1/18* (2013.01); *C21D 1/673* (2013.01); *C21D 3/04* (2013.01); *C21D 8/0405* (2013.01); *C21D 8/0436* (2013.01); *C21D 8/0457* (2013.01); *C21D 9/00* (2013.01); *C22C 38/00* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/38* (2013.01); *C22C 38/58* (2013.01); *B21D 22/022* (2013.01); *C21D 2211/005* (2013.01); *C21D 2211/008* (2013.01); *C21D 2221/00* (2013.01)

(58) Field of Classification Search
None
See application file for complete search history.

(56) References Cited

U.S. PATENT DOCUMENTS

| | | | | |
|---|---|---|---|---|
| 2005/0257862 | A1 | 11/2005 | Asai et al. | |
| 2009/0050241 | A1 | 2/2009 | Hashimura et al. | |
| 2014/0342185 | A1* | 11/2014 | Nonaka | C23C 2/02 428/659 |
| 2015/0010775 | A1 | 1/2015 | Nonaka et al. | |
| 2015/0144231 | A1* | 5/2015 | Masuda | C21D 9/46 148/603 |

FOREIGN PATENT DOCUMENTS

| | | | |
|---|---|---|---|
| CA | 2770585 | A1 | 2/2011 |
| CA | 2780082 | A1 | 10/2011 |
| CA | 2933435 | A1 | 6/2015 |
| CN | 102282280 | A | 12/2011 |
| EP | 2371978 | A1 | 10/2011 |
| EP | 2 578 711 | A1 | 4/2013 |
| GB | 1 490 535 | A | 11/1977 |
| JP | 10-96031 | A | 4/1998 |
| JP | 2005-329449 | A | 12/2005 |
| JP | 2006-104546 | A | 4/2006 |
| JP | 2006-265568 | A | 10/2006 |
| JP | 2007-16296 | A | 1/2007 |
| JP | 2007-154258 | A | 6/2007 |
| JP | 2008-264836 | A | 11/2008 |
| JP | 2010-65292 | A | 3/2010 |
| JP | 2011-99149 | A | 5/2011 |
| JP | 2013-249502 | A | 12/2013 |
| JP | 2014-25131 | A | 2/2014 |
| TW | 200415243 | A | 8/2004 |
| TW | 201335385 | A1 | 9/2013 |

OTHER PUBLICATIONS

Machine—English translation of JP 2011-214070, Imai Norio et al., dated Oct. 27, 2011.*

Machine—English translation of JP 2010-090432, Yoshino Masataka et al., dated Apr. 22, 2010.*

WO2013/105638, Nonaka Toshiki et al., Jul. 18, 2013.*

English translation of the International Preliminary Report on Patentability and Written Opinion of the International Searching Authority (Forms PCT/IB/338, PCT/IB/373 and PCT/ISA/237) dated Jul. 7, 2016, for International Application No. PCT/JP2013/085167.

(Continued)

*Primary Examiner* — Deborah Yee

(74) *Attorney, Agent, or Firm* — Birch, Stewart, Kolasch & Birch, LLP

(57) ABSTRACT

A hot-pressed steel sheet member includes a specific chemical composition and further includes a steel structure in which an area ratio of ferrite in a surface layer portion ranging from a surface to 15 μm in depth is greater than 1.20 times an area ratio of ferrite in an inner layer portion being a portion excluding the surface layer portion, and the inner layer portion contains a steel structure represented, in area %, ferrite: 10% to 70%, martensite: 30% to 90%, and a total area ratio of ferrite and martensite: 90% to 100%. A tensile strength of the hot-pressed steel sheet member is 980 MPa or more.

5 Claims, No Drawings

(56) References Cited

OTHER PUBLICATIONS

Chinese Office Action and Search Report, dated Dec. 23, 2016, for corresponding Chinese Application No. 201380081705.4, along with an English Summary of the Office Action.
International Search Report for PCT/JP2013/085167 dated Apr. 8, 2014.
Written Opinion of the International Searching Authority for PCT/JP2013/085167 (PCT/ISA/237) dated Apr. 8, 2014.
Canadian Office Action and Search Report, dated Apr. 28, 2017, for corresponding Canadian Application No. 2,934,597.
Korean Office Action, dated Apr. 4, 2017, for corresponding Korean Application No. 10-2016-7017162.
Extended European Search Report dated Jun. 21, 2017, issued in corresponding European Patent Application No. 13900077.2.

* cited by examiner

HOT-PRESSED STEEL SHEET MEMBER

TECHNICAL FIELD

The present invention relates to a hot-pressed steel sheet member used for a machine structural component and the like, a method of manufacturing the same, and a steel sheet for hot pressing.

BACKGROUND ART

For reduction in weight of an automobile, efforts are advanced to increase the strength of a steel material used for an automobile body and to reduce the weight of steel material used. In a thin steel sheet widely used for the automobile, press formability thereof generally decreases with an increase in strength, making it difficult to manufacture a component having a complicated shape. For example, a highly processed portion fractures with a decrease in ductility, and springback becomes prominent to deteriorate dimensional accuracy. Accordingly, it is difficult to manufacture components by performing press-forming on a high-strength steel sheet, in particular, a steel sheet having a tensile strength of 980 MPa or more. It is easy to process the high-strength steel sheet not by press-forming but by roll-forming, but its application target is limited to a component having a uniform cross section in a longitudinal direction.

Methods called hot pressing intended to obtain high formability in the high-strength steel sheet are described in Patent Literatures 1 and 2. By the hot pressing, it is possible to form the high-strength steel sheet with high accuracy to obtain a high-strength hot-pressed steel sheet member.

On the other hand, the hot-pressed steel sheet member is also required to be improved in crashworthiness when the hot-pressed steel sheet member is used for an automobile. The crashworthiness can be improved to some extent by an improvement in ductility. However, steel structure of the steel sheet obtained by the methods described in Patent Literatures 1 and 2 is substantially a martensite single phase, and thus it is difficult for the methods to improve in ductility.

High-strength hot-pressed steel sheet members intended to improve in ductility are described in Patent Literatures 3 to 5, but it is difficult for these conventional hot-pressed steel sheet members to obtain a sufficient crashworthiness. Techniques related to hot pressing are described also in Patent Literatures 6 to 8, but these are also difficult to obtain a sufficient crashworthiness.

CITATION LIST

Patent Literature

Patent Literature 1: U.K. Patent No. 1490535

Patent Literature 2: Japanese Laid-open Patent Publication No. 10-96031

Patent Literature 3: Japanese Laid-open Patent Publication No. 2010-65292

Patent Literature 4: Japanese Laid-open Patent Publication No. 2007-16296

Patent Literature 5: Japanese Laid-open Patent Publication No. 2005-329449

Patent Literature 6: Japanese Laid-open Patent Publication No. 2006-104546

Patent Literature 7: Japanese Laid-open Patent Publication No. 2006-265568

Patent Literature 8: Japanese Laid-open Patent Publication No. 2007-154258

SUMMARY OF INVENTION

Technical Problem

An object of the present invention is to provide a hot-pressed steel sheet member having a high strength and an excellent crashworthiness, a method of manufacturing the same, and a steel sheet for hot pressing.

Solution to Problem

The inventor of the present application studied the reason why it is difficult to obtain excellent crashworthiness even with the conventional high-strength hot-pressed steel sheet member intended to improve in ductility. As a result, it was found out that not only an improvement in ductility but also an improvement in bendability is important for an improvement in crashworthiness. The reason why the bendability is also important is because extreme plastic deformation occurs in the hot-pressed steel sheet member and a surface layer portion of the hot-pressed steel sheet member is sometimes subjected to severe bending deformation at crash. It also became clear that the degree of importance of bendability becomes obvious when a tensile strength is 980 MPa or more.

As a result of earnest studies based on such findings, the inventor of the present application has found that a hot-pressed steel sheet member having a steel structure being a multi-phase structure containing ferrite and martensite, and having an increased area ratio of ferrite of a surface layer portion compared to that of an inner layer portion can be obtained by treating a steel sheet for hot pressing having a chemical composition containing specific amounts of C and Mn and relatively large amount of Si, and having a specific steel structure including hot pressing under specific conditions. Further, the inventor of the present application has also found that this hot-pressed steel sheet member has a high tensile strength of 980 MPa or more and also has excellent ductility and bendability. Then, the inventor of the present application has reached the following various aspects of the invention.

(1)

A hot-pressed steel sheet member, including:

a chemical composition represented by, in mass %:

C: 0.10% to 0.34%;

Si: 0.5% to 2.0%;

Mn: 1.0% to 3.0%;

sol. Al: 0.001% to 1.0%;

P: 0.05% or less;

S: 0.01% or less;

N: 0.01% or less;

Ti: 0% to 0.20%;

Nb: 0% to 0.20%;

V: 0% to 0.20%;

Cr: 0% to 1.0%;

Mo: 0% to 1.0%;

Cu: 0% to 1.0%;

Ni: 0% to 1.0%;

Ca: 0% to 0.01%;

Mg: 0% to 0.01%;

REM: 0% to 0.01%;

Zr: 0% to 0.01%;

B: 0% to 0.01%;

Bi: 0% to 0.01%; and balance: Fe and impurities; and a steel structure in which:

an area ratio of ferrite in a surface layer portion ranging from a surface to 15 μm in depth is greater than 1.20 times an area ratio of ferrite in an inner layer portion being a portion excluding the surface layer portion; and the inner layer portion contains a steel structure represented, in area %:

ferrite: 10% to 70%;

martensite: 30% to 90%; and a total area ratio of ferrite and martensite: 90% to 100%, wherein a tensile strength of the hot-pressed steel sheet member is 980 MPa or more.

(2)

The hot-pressed steel sheet member according to (1), wherein the chemical composition contains one or more selected from the group consisting of, in mass %:

Ti: 0.003% to 0.20%;

Nb: 0.003% to 0.20%;

V: 0.003% to 0.20%;

Cr: 0.005% to 1.0%;

Mo: 0.005% to 1.0%;

Cu: 0.005% to 1.0%; and

Ni: 0.005% to 1.0%.

(3)

The hot-pressed steel sheet member according to (1) or (2), wherein the chemical composition contains one or more selected from the group consisting of, in mass %:

Ca: 0.0003% to 0.01%;

Mg: 0.0003% to 0.01%;

REM: 0.0003% to 0.01%; and

Zr: 0.0003% to 0.01%.

(4)

The hot-pressed steel sheet member according to any one of (1) to (3), wherein the chemical composition contains, in mass %, B: 0.0003% to 0.01%.

(5)

The hot-pressed steel sheet member according to any one of (1) to (4), wherein the chemical composition contains, in mass %, Bi: 0.0003% to 0.01%.

(6)

A steel sheet for hot pressing, including:

a chemical composition represented by, in mass %:

C: 0.11% to 0.35%;

Si: 0.5% to 2.0%;

Mn: 1.0% to 3.0%;

sol. Al: 0.001% to 1.0%;

P: 0.05% or less;

S: 0.01% or less;

N: 0.01% or less;

Ti: 0% to 0.20%;

Nb: 0% to 0.20%;

V: 0% to 0.20%;

Cr: 0% to 1.0%;

Mo: 0% to 1.0%;

Cu: 0% to 1.0%;

Ni: 0% to 1.0%;

Ca: 0% to 0.01%;

Mg: 0% to 0.01%;

REM: 0% to 0.01%;

Zr: 0% to 0.01%;

B: 0% to 0.01%;

Bi: 0% to 0.01%; and balance: Fe and impurities; and an internal oxide layer including a thickness of 30 μm or less; and a steel structure in which an area ratio of ferrite in a region ranging from a surface to 100 μm in depth is 30% to 90% and an area ratio of pearlite including an average grain diameter of 5 μm or more in a region excluding the region ranging from the surface to 100 μm in depth is 10% to 70%.

(7)

The steel sheet for hot pressing according to (6), wherein the chemical composition contains one or more selected from the group consisting of, in mass %:

Ti: 0.003% to 0.20%;

Nb: 0.003% to 0.20%;

V: 0.003% to 0.20%;

Cr: 0.005% to 1.0%;

Mo: 0.005% to 1.0%;

Cu: 0.005% to 1.0%; and

Ni: 0.005% to 1.0%.

(8)

The steel sheet for hot pressing according to (6) or (7), wherein the chemical composition contains one or more selected from the group consisting of, in mass %:

Ca: 0.0003% to 0.01%;

Mg: 0.0003% to 0.01%;

REM: 0.0003% to 0.01%; and

Zr: 0.0003% to 0.01%.

(9)

The steel sheet for hot pressing according to any one of (6) to (8), wherein the chemical composition contains, in mass %, B: 0.0003% to 0.01%.

(10)

The steel sheet for hot pressing according to any one of (6) to (9), wherein the chemical composition contains, in mass %, Bi: 0.0003% to 0.01%.

(11)

A method of manufacturing a hot-pressed steel sheet member, including:

a step of heating the steel sheet for hot pressing according to any one of (6) to (10) in a temperature zone of 720° C. to an $Ac_3$ point;

a step of performing a decarburization treatment of reducing a C content on a surface of the steel sheet for hot pressing by 0.0005 mass % to 0.015 mass % after the heating; and a step of hot pressing and cooling down to an Ms point at an average cooling rate of 10° C./second to 500° C./second after the decarburization treatment.

(12)

The method of manufacturing the hot-pressed steel sheet member according to (11), wherein the step of performing a decarburization treatment includes performing air cooling for 5 seconds to 50 seconds.

Advantageous Effects of Invention

According to the present invention, it is possible to obtain a high tensile strength and an excellent crashworthiness. Particularly, when a hot-pressed steel sheet member according to the present invention is used for a body structural component of an automobile, an impact can be absorbed with bending deformation of a surface layer portion even when crash that causes extreme plastic deformation occurs.

DESCRIPTION OF EMBODIMENTS

Hereinafter, embodiments of the present invention will be described. The embodiments of the present invention relate to a hot-pressed steel sheet member having a tensile strength of 980 MPa or more.

First, chemical compositions of the hot-pressed steel sheet member (hereinafter, sometimes referred to as a "steel sheet member") according to the embodiment of the present invention and a steel sheet for hot pressing used for manufacturing the same will be described. In the following description, "%" being a unit of a content of each element contained in the steel sheet member or the steel sheet for hot pressing means "mass %" unless otherwise specified.

The chemical composition of the steel sheet member according to the embodiment is represented by, in mass %, C: 0.10% to 0.34%, Si: 0.5% to 2.0%, Mn: 1.0% to 3.0%, sol. Al: 0.001% to 1.0%, P: 0.05% or less, S: 0.01% or less, N: 0.01% or less, Ti: 0% to 0.20%, Nb: 0% to 0.20%, V: 0% to 0.20%, Cr: 0% to 1.0%, Mo: 0% to 1.0%, Cu: 0% to 1.0%, Ni: 0% to 1.0%, Ca: 0% to 0.01%, Mg: 0% to 0.01%, REM: 0% to 0.01%, Zr: 0% to 0.01%, B: 0% to 0.01%, Bi: 0% to 0.01%, and balance: Fe and impurities. The chemical composition of the steel sheet for hot pressing used for manufacturing the steel sheet member according to the embodiment is represented by, in mass %, C: 0.11% to 0.35%, Si: 0.5% to 2.0%, Mn: 1.0% to 3.0%, sol. Al: 0.001% to 1.0%, P: 0.05% or less, S: 0.01% or less, N: 0.01% or less, Ti: 0% to 0.20%, Nb: 0% to 0.20%, V: 0% to 0.20%, Cr: 0% to 1.0%, Mo: 0% to 1.0%, Cu: 0% to 1.0%, Ni: 0% to 1.0%, Ca: 0% to 0.01%, Mg: 0% to 0.01%, REM: 0% to 0.01%, Zr: 0% to 0.01%, B: 0% to 0.01%, Bi: 0% to 0.01%, and balance: Fe and impurities. Examples of the impurities include ones contained in raw materials such as ore and scrap, and ones mixed in during a manufacturing process.

(C of the hot-pressed steel sheet member: 0.10% to 0.34% and C of the steel sheet for hot pressing: 0.11% to 0.35%)

C is a very important element which increases hardenability of the steel sheet for hot pressing and mainly determines the strength of the steel sheet member. When the C content of the steel sheet member is less than 0.10%, it may be difficult to secure the tensile strength of 980 MPa or more. Accordingly, the C content of the steel sheet member is 0.10% or more. When the C content of the steel sheet member is greater than 0.34%, decreases in bendability and weldability may be significant. Thus, the C content of the steel sheet member is 0.34% or less. In terms of productivity in hot-rolling and cold-rolling for obtaining the steel sheet for hot pressing, the C content of the steel sheet for hot pressing is preferably 0.30% or less, and more preferably 0.25% or less. As described later, a decarburization treatment for the steel sheet for hot pressing is performed when manufacturing the hot-pressed steel sheet member, and therefore C is contained more in the steel sheet for hot pressing by an amount corresponding to the decarburization treatment and the C content of the steel sheet for hot pressing is 0.11% or more and 0.35% or less.

(Si: 0.5% to 2.0%)

Si is a very effective element for improving ductility of the steel sheet member and stably securing strength of the steel sheet member. When the Si content is less than 0.5%, it may be difficult to obtain the above-described effects. Thus, the Si content is 0.5% or more. When the Si content is greater than 2.0%, the above-described effect may be saturated to result in economical disadvantage, and plating wettability significantly decreases to frequently cause unplating. Thus, the Si content is 2.0% or less. In terms of improving weldability, the Si content is preferably 0.7% or more. In terms of suppressing surface defects of the steel sheet member, the Si content is preferably 1.8% or less.

(Mn: 1.0% to 3.0%)

Mn is a very effective element for improving hardenability of the steel sheet for hot pressing and securing strength of the steel sheet member. When the Mn content is less than 1.0%, it may be very difficult to secure a tensile strength of 980 MPa or more in the steel sheet member. Thus, the Mn content is 1.0% or more. For more securely obtaining the above-described effects, the Mn content is preferably 1.1% or more. When the Mn content is greater than 3.0%, the steel structure of the steel sheet member may become a significant band structure and deterioration of bendability may become significant. Thus, the Mn content is 3.0% or less. In terms of productivity in hot-rolling and cold-rolling for obtaining the steel sheet for hot pressing, the Mn content is preferably 2.5% or less.

(Sol. Al (Acid-Soluble Al): 0.001% to 1.0%)

Al is an element having an effect of deoxidizing steel to make steel material better. When the sol. Al content is less than 0.001%, it may be difficult to obtain the above-described effect. Thus, the sol. Al content is 0.001% or more. In order to more securely obtain the above-described effect, the sol. Al content is preferably 0.015% or more. When the sol. Al content is greater than 1.0%, the weldability significantly may decrease, oxide-based inclusions may increase, and the surface property may significantly deteriorate. Thus, the sol. Al content is 1.0% or less. In order to obtain better surface property, the sol. Al content is preferably 0.080% or less.

(P: 0.05% or Less)

P is not an essential element and is contained, for example, as an impurity in steel. In terms of weldability, a lower P content is better. In particular, when the P content is more than 0.05%, the weldability may significantly decrease. Thus, the P content is 0.05% or less. In order to secure better weldability, the P content is preferably 0.018% or less. On the other hand, P has an effect of enhancing the strength of the steel by solid solution strengthening. To obtain the effect, 0.003% or more of P may be contained.

(S: 0.01% or Less)

S is not an essential element and is contained, for example, as an impurity in steel. In terms of the weldability, a lower S content is better. In particular, when the S content is more than 0.01%, the weldability may significantly decrease. Thus, the S content is 0.01% or less. In order to secure better weldability, the s content is preferably 0.003% or less, and more preferably 0.0015% or less.

(N: 0.01% or Less)

N is not an essential element and is contained, for example, as an impurity in steel. In terms of the weldability, a lower N content is better. In particular, when the N content is more than 0.01%, the weldability may significantly decrease. Thus, the N content is 0.01% or less. In order to secure better weldability, the N content is preferably 0.006% or less.

Ti, Nb, V, Cr, Mo, Cu, Ni, Ca, Mg, REM, Zr, B, and Bi are not essential elements, and are arbitrary elements which may be appropriately contained, up to a specific amount as a limit, in the steel sheet member and the steel sheet for hot pressing.

(Ti: 0% to 0.20%, Nb: 0% to 0.20%, V: 0% to 0.20%, Cr: 0% to 1.0%, Mo: 0% to 1.0%, Cu: 0% to 1.0%, and Ni: 0% to 1.0%)

Each of Ti, Nb, V, Cr, Mo, Cu, and Ni is an element effective for stably securing strength of the steel sheet member. Thus, one or more selected from the group consisting of these elements may also be contained. However, when the content of one of Ti, Nb, and V is more than 0.20%, hot-rolling and cold-rolling for obtaining the steel sheet for hot pressing may become difficult to be performed, and further it may become difficult to stably secure strength.

Thus, the Ti content, the Nb content, and the V content are each 0.20% or less. When the content of one of Cr and Mo is more than 1.0%, hot-rolling and cold-rolling for obtaining the steel sheet for hot pressing may become difficult to be performed. Thus, the Cr content and the Mo content are each 1.0% or less. When the content of one of Cu and Ni is 1.0%, the above-described effects may be saturated to result in economical disadvantage, and hot-rolling and cold-rolling for obtaining the steel sheet for hot pressing may become difficult to be performed. Thus, the Cu content and the Ni content are each 1.0% or less. In order to stably secure the strength of the steel sheet member, each of the Ti content, the Nb content, and the V content is preferably 0.003% or more, and each of the Cr content, the Mo content, the Cu content, and the Ni content is preferably 0.005% or more. That is, at least one of "Ti: 0.003% to 0.20%," "Nb: 0.003% to 0.20%," "V: 0.003% to 0.20%," "Cr: 0.005% to 1.0%," "Mo: 0.005% to 1.0%," "Cu: 0.005% to 1.0%," and "Ni: 0.005% to 1.0%" is preferably satisfied.

(Ca: 0% to 0.01%, Mg: 0% to 0.01%, REM: 0% to 0.01%, and Zr: 0% to 0.01%)

Each of Ca, Mg, REM, and Zr is an element which has an effect of contributing to control of inclusions, in particular, fine dispersion of inclusions to enhance low temperature toughness. Thus, one or more selected from the group consisting of these elements may be contained. However, when the content of any one of them is more than 0.01%, the deterioration in surface property may become obvious. Thus, each of the Ca content, the Mg content, the REM content, and the Zr content is 0.01% or less. In order to improve the low temperature toughness, each of the Ca content, the Mg content, the REM content, and the Zr content is preferably 0.0003% or more. That is, at least one of "Ca: 0.0003% to 0.01%," "Mg: 0.0003% to 0.01%," "REM: 0.0003% to 0.01%," and "Zr: 0.0003% to 0.01%" is preferably satisfied.

REM (rare-earth metal) indicates 17 kinds of elements in total of Sc, Y, and lanthanoid, and the "REM content" means a total content of these 17 kinds of elements. Lanthanoid is industrially added as a form of, for example, misch metal.

(B: 0% to 0.01%)

B is an element having an effect to enhance low temperature toughness of the steel sheet. Thus, B may be contained. However, when the B content is more than 0.01%, hot workability may deteriorate, and hot-rolling for obtaining the steel sheet for hot pressing may become difficult. Thus, the B content is 0.01% or less. In order to improve the low temperature toughness, the B content is preferably 0.0003% or more. That is, the B content is preferably 0.0003% to 0.01%.

(Bi: 0% to 0.01%)

Bi is an element having an effect to uniformize the steel structure and enhance low temperature toughness of the steel sheet. Thus, Bi may be contained. However, when the Bi content is more than 0.01%, hot workability may deteriorate, and hot-rolling for obtaining the steel sheet for hot pressing may become difficult. Thus, the Bi content is 0.01% or less. In order to improve the low temperature toughness, the Bi content is preferably 0.0003% or more. That is, the Bi content is preferably 0.0003% to 0.01%.

Next, the steel structure of the steel sheet member according to the embodiment will be described. This steel sheet member includes a steel structure in which an area ratio of ferrite in a surface layer portion ranging from the surface to 15 μm in depth is greater than 1.20 times an area ratio of ferrite in an inner layer portion being a portion excluding the surface layer portion, and the inner layer portion includes the steel structure represented, in area %, ferrite: 10% to 70%, and martensite: 30% to 90%, and a total area ratio of ferrite and martensite: 90% to 100%. The surface layer portion of the steel sheet member means a surface portion ranging from the surface to 15 μm in depth, and the inner layer portion means a portion excluding this surface layer portion. That is, the inner layer portion is a portion other than the surface layer portion of the steel sheet member. Each of numerical values relating to the steel structure of the inner layer portion is, for example, an average value of the whole of the inner layer portion in a thickness direction, but it may be represented by a numerical value relating to the steel structure at a point where the depth from the surface of the steel sheet member is ¼ of the thickness of the steel sheet member (hereinafter, this point is sometimes referred to as a "¼ depth position"). For example, when the thickness of the steel sheet member is 2.0 mm, it may be represented by a numerical value at a point positioned at 0.50 mm in depth from the surface. This is because the steel structure at the ¼ depth position indicates an average steel structure in the thickness direction of the steel sheet member. Thus, in the present invention, the area ratio of ferrite and the area ratio of martensite measured at the ¼ depth position are regarded as an area ratio of ferrite and an area ratio of martensite in the inner layer portion respectively.

(Area Ratio of Ferrite in the Surface Layer Portion: Greater than 1.20 Times the Area Ratio of Ferrite in the Inner Layer Portion)

The area ratio of ferrite in the surface layer portion is higher than the area ratio of ferrite in the inner layer portion, to thereby make the surface layer portion high in ductility, and even when it has a high tensile strength of 980 MPa or more, excellent ductility and bendability can be obtained. When the area ratio of ferrite in the surface layer portion is equal to or less than 1.20 times the area ratio of ferrite in the inner layer portion, microcracks may become likely to occur in the surface layer portion, to make it difficult to obtain sufficient bendability. Thus, the area ratio of ferrite in the surface layer portion is greater than 1.20 times the area ratio of ferrite in the inner layer portion.

(Area Ratio of Ferrite in the Inner Layer Portion: 10% to 70%)

A specific amount of ferrite is made to exist in the inner layer portion, thereby making it possible to obtain good ductility. When the area ratio of ferrite in the inner layer portion is less than 10%, most of the ferrite may be isolated, to make it difficult to obtain good ductility. Thus, the area ratio of ferrite in the inner layer portion is 10% or more. When the area ratio of ferrite in the inner layer portion is greater than 70%, martensite being a strengthening phase may not be sufficiently secured and it may be difficult to secure a tensile strength of 980 MPa or more. Thus, the area ratio of ferrite in the inner layer portion is 70% or less.

(Area Ratio of Martensite in the Inner Layer Portion: 30% to 90%)

A specific amount of martensite is made to exist in the inner layer portion, thereby making it possible to obtain a high strength. When the area ratio of martensite in the inner layer portion is less than 30%, it may be difficult to secure a tensile strength of 980 MPa or more. Thus, the area ratio of martensite in the inner layer portion is 30% or more. When the area ratio of martensite in the inner layer portion is greater than 90%, the area ratio of ferrite becomes less than 10%, resulting in that it may be difficult to obtain good ductility as described above. Thus, the area ratio of martensite in the inner layer portion is 90% or less.

(Total Area Ratio of Ferrite and Martensite in the Inner Layer Portion: 90% to 100%)

The inner layer portion of the hot-pressed steel sheet member according to the embodiment is preferably composed of ferrite and martensite, namely, the total area ratio of ferrite and martensite is preferably 100%. However, depending on the manufacturing conditions, one or more selected from the group consisting of bainite, retained austenite, cementite, and pearlite may be contained as a phase or a structure other than ferrite and martensite. In this case, when the area ratio of the phase or the structure other than ferrite and martensite is greater than 10%, target properties may not be obtained in some cases due to the influence of the phase or the structure. Accordingly, the area ratio of the phase or the structure other than ferrite and martensite in the inner layer portion is 10% or less. That is, the total area ratio of ferrite and martensite in the inner layer portion is 90% or more.

As a method of measuring the area ratio of each phase in the above steel structure, a method well-known to the skilled person in the art may be employed. Each of the area ratios is obtained, for example, as an average value of a value measured in a cross section perpendicular to a rolling direction and a value measured in a cross section perpendicular to a sheet width direction (a direction perpendicular to the rolling direction). In other words, the area ratio is obtained, for example, as an average value of area ratios measured in two cross sections.

The steel sheet member can be manufactured by treating a specific steel sheet for hot pressing under specific conditions.

Here, a steel structure and the like in the steel sheet for hot pressing used for manufacturing the steel sheet member according to the embodiment will be described. This steel sheet for hot pressing includes an internal oxide layer having a thickness of 30 μm or less, and includes a steel structure in which an area ratio of ferrite in a region ranging from the surface to 100 μm in depth is 30% to 90% and an area ratio of pearlite having an average grain diameter of 5 μm or more in a region excluding the region ranging from the surface to 100 μm in depth is 10% to 70%.

(Thickness of the Internal Oxide Layer: 30 μm or Less)

As the internal oxide layer is thicker, bendability of the steel sheet member decreases, and when the thickness of the internal oxide layer is greater than 30 μm, the bendability may significantly decrease. Thus, the thickness of the internal oxide layer is 30 μm or less. For example, the internal oxide layer can be observed by an electron microscope, and the thickness of the internal oxide layer can be measured by an electron microscope.

(Area Ratio of Ferrite in a Region Ranging from the Surface to 100 μm in Depth: 30% to 90%)

Ferrite in the region ranging from the surface to 100 μm in depth contributes to securing the ferrite in the surface layer portion of the steel sheet member. When the area ratio of ferrite in this region is less than 30%, it may be difficult to make the area ratio of ferrite in the surface layer portion of the steel sheet member become greater than 1.20 times the area ratio in the inner layer portion. Thus, the area ratio of ferrite in the region ranging from the surface to 100 μm in depth is 30% or more. When the area ratio of ferrite in this region is greater than 90%, it may be difficult to make the area ratio of ferrite in the inner layer portion of the steel sheet member become 70% or less. Thus, the area ratio of ferrite in the region ranging from the surface to 100 μm in depth is 90% or less.

(Area Ratio of Pearlite Having an Average Grain Diameter of 5 μm or More in a Region Excluding the Region Ranging from the Surface to 100 μm in Depth: 10% to 70%)

Pearlite having an average grain diameter of 5 μm or more in the region excluding the region ranging from the surface to 100 μm in depth contributes to formation of martensite in the inner layer portion of the steel sheet member. When the area ratio of pearlite having an average grain diameter of 5 μm or more in this region is less than 10%, it may be difficult to make the area ratio of martensite in the inner layer portion of the steel sheet member become 30% or more. Thus, the area ratio of pearlite in this region is 10% or more. When the area ratio of pearlite having an average grain diameter of 5 μm or more in this region is greater than 70%, it may be difficult to make the area ratio of martensite in the inner layer portion of the steel sheet member become 90% or less. Thus, the area ratio of pearlite in this region is 70% or less. The area ratio of pearlite in this region is likely to be affected by the C content in the steel sheet for hot pressing. When the area ratio of pearlite is greater than 70%, the C content of the steel sheet for hot pressing used for manufacturing the steel sheet member is often greater than 0.35%. Thus, for making the area ratio of pearlite having an average grain diameter of 5 μm or more in the region excluding the region ranging from the surface to 100 μm in depth become 70% or less, for example, it is effective to use a steel sheet for hot pressing whose C content is 0.35% or less. The average grain diameter of pearlite means an average value of a diameter of a pearlite grain in the rolling direction and in the sheet width direction (the direction perpendicular to the rolling direction).

As the steel sheet for hot pressing, for example, a hot-rolled steel sheet, a cold-rolled steel sheet, a hot-dip galvanized cold-rolled steel sheet, or the like can be used. For example, a hot-rolled steel sheet including the above-described steel structure can be manufactured by hot-rolling including finish rolling at 850° C. or more, holding the temperature in a range of 720° C. to 650° C. for 10 seconds or more, and then coiling in a temperature zone of 600° C. or more. For example, a cold-rolled steel sheet and a hot-dip galvanized cold-rolled steel sheet including the above-described steel structure can be manufactured through annealing in a temperature zone of 720° C. to 850° C. in a mixed gas atmosphere of nitrogen and hydrogen whose dew point is −10° C. or more after cold rolling.

Next, a method of manufacturing the steel sheet member according to the embodiment, namely, a method of treating the steel sheet for hot pressing will be described. In the treatment of the steel sheet for hot pressing, the steel sheet for hot pressing is heated in a temperature zone of 720° C. to an $Ac_3$ point, a decarburization treatment of reducing a C content on a surface of the steel sheet for hot pressing by 0.0005 mass % to 0.015 mass % is performed after the heating, and hot pressing and cooling down to an Ms point at an average cooling rate of 10° C./second to 500° C./second is performed after the decarburization treatment.

(Heating Temperature of the Steel Sheet for Hot Pressing: A Temperature Zone of 720° C. to an $Ac_3$ Point)

The steel sheet to be subjected to hot pressing, namely, the steel sheet for hot pressing is heated in a temperature zone of 720° C. to the $Ac_3$ point. The $Ac_3$ point is a temperature (unit: ° C.) at which the steel structure becomes an austenite single phase, which is calculated by the following empirical formula (i).

$$Ac_3=910-203\times(C^{0.5})-15.2\times Ni+44.7\times Si+104\times V+31.5\times Mo-30\times Mn-11\times Cr-20\times Cu+700\times P+400\times Al+50\times Ti \quad (i)$$

Here, the element symbol in the above formula indicates the content (unit: mass %) of each element in a chemical composition of the steel sheet.

When the heating temperature is less than 720° C., formation of austenite accompanying solid solution of cementite may be difficult or insufficient, resulting in a difficulty in making the tensile strength of the steel sheet member become 980 MPa or more. Thus, the heating temperature is 720° C. or more. When the heating temperature is greater than the $Ac_3$ point, the steel structure of the steel sheet member may become a martensite single phase, resulting in significant deterioration of ductility. Thus, the heating temperature is the $Ac_3$ point or less.

The heating rate up to the temperature zone of 720° C. to the $Ac_3$ point and the heating time for holding at the above-described temperature zone are not limited in particular, but they are each preferably within the following range.

An average heating rate in the heating up to the temperature zone of 720° C. to the $Ac_3$ point is preferably 0.2° C./second to 100° C./second. Setting the average heating rate to 0.2° C./second or more makes it possible to secure higher productivity. Further, setting the average heating rate to 100° C./second or less makes it easy to control the heating temperature when it is heated by using a normal furnace.

The heating time in the temperature zone of 720° C. to the $Ac_3$ point is preferably 1 minute to 10 minutes. The heating time is a time period from the time which the temperature of the steel sheet reaches 720° C. to a heating end time. The heating end time, specifically, is the time which the steel sheet is taken out of the heating furnace in the case of furnace heating, and is the time which energization or the like is turned off in the case of energization heating or induction heating. The heating time is 1 minute or more, and thereby ferrite is likely to be formed in the surface layer portion by decarburization during heating, and the area ratio of ferrite in the surface layer portion becomes likely to be greater than 1.20 times the area ratio of ferrite in the inner layer portion. For obtaining the above-described effects more securely, the heating time is more preferably 4 minutes or more. By setting the heating time to 10 minutes or less, the steel structure of the steel sheet member can be made finer, resulting in a further improvement in low temperature toughness of the steel sheet member.

(Decarburized Amount by the Decarburization Treatment: 0.0005 Mass % to 0.015 Mass %)

By the decarburization treatment, ferrite is more likely to be formed in a portion to be the surface layer portion of the steel sheet member than in a portion to be the inner layer portion. When the decarburized amount is less than 0.0005 mass %, the above-described effect may not be obtained sufficiently, resulting in a difficulty in making the area ratio of ferrite in the surface layer portion become greater than 1.20 times the area ratio of ferrite in the inner layer portion. Thus, the decarburized amount is 0.0005 mass % or more. When the decarburized amount is greater than 0.015 mass %, bainite transformation may occur during the decarburization treatment, resulting in that it may be difficult to secure a sufficient amount of martensite in the steel sheet member, that is, to obtain a tensile strength of 980 MPa or more. Thus, the decarburized amount is 0.015 mass % or less. The decarburized amount can be measured by using, for example, a glow discharge spectroscope (GDS) or an electron probe micro analyzer (EPMA). That is, a surface of the steel sheet for hot pressing before and after the decarburization treatment is analyzed and results of the analyses are compared, and thereby the decarburized amount can be found.

A method of the decarburization treatment is not limited in particular, and the decarburization treatment can be performed by, for example, air cooling. For example, between extraction from a heating device such as a heating furnace used for the above-described heating and input into a hot pressing device, air cooling which atmosphere, temperature, time, and the like are appropriately controlled is performed, and thereby the decarburization treatment can be performed. More specifically, air cooling can be performed, for example, when extracting from the heating device, when transferring from the heating device to the hot pressing device, or when inputting into the hot pressing device.

Then, when such air cooling is performed, an air cooling time between completion of the heating and start of hot pressing is preferably 5 seconds to 50 seconds. By setting the air cooling time to 5 seconds or more, a sufficient decarburization treatment can be performed, resulting in that it is possible to easily make the area ratio of ferrite in the surface layer portion become greater than 1.20 times the area ratio of ferrite in the inner layer portion. By setting the air cooling time to 50 seconds or less, progress of bainite transformation is suppressed and securing the area ratio of martensite being a strengthening phase is facilitated, resulting in that it becomes easy to make the tensile strength of the hot-pressed steel sheet member become 980 MPa or more. For more securely obtaining the above-described effects, the air cooling time is preferably 30 seconds or less, and more preferably 20 seconds or less.

The air cooling time can be adjusted by, for example, controlling a transfer time from extraction from the heating device to a press die of the hot pressing device.

(Average Cooling Rate Down to the Ms Point: not Less than 10° C./Second Nor More than 500° C./Second)

After the air cooling, hot pressing and cooling down to the Ms point at an average cooling rate of 10° C./second to 500° C./second is performed. When the average cooling rate is less than 10° C./second, diffusional transformation such as bainite transformation may progress excessively to thereby make it difficult to secure the area ratio of martensite being a strengthening phase, resulting in a difficulty in making the tensile strength of the steel sheet member become 980 MPa or more. Thus, the average cooling rate is 10° C./second or more. When the average cooling rate is greater than 500° C./second, it may become very difficult to hold soaking of the member, resulting in that strength is no longer stabilized. Thus, the average cooling rate is 500° C./second or less.

In this cooling, heat generation by phase transformation is likely to extremely increase after the temperature reaches 400° C. Therefore, when the cooling in a low temperature zone of less than 400° C. is performed by the same method as the cooling in a temperature zone of 400° C. or more, it may be difficult to secure a sufficient average cooling rate in some cases. It is preferable to perform the cooling down to the Ms point from 400° C. more forcibly than the cooling down to 400° C. For example, it is preferable to employ the following method.

Generally, the cooling in the hot pressing is performed by setting a die made of steel used for forming a heated steel sheet to normal temperature or a temperature of about several tens of degrees centigrade in advance and bringing the steel sheet into contact with the die. Accordingly, the average cooling rate can be controlled, for example, by change in heat capacity with the change in dimension of the die. The average cooling rate can be also controlled by changing the material of the die to a different metal (for example, Cu or the like). The average cooling rate can be also controlled by using a water-cooling die and changing the amount of cooling water flowing through the die. The average cooling rate can be also controlled by forming a plurality of grooves in the die in advance and passing water through the grooves during hot pressing. The average cooling rate can be also controlled by raising a hot pressing machine in the middle of hot pressing and passing water through its space. The average cooling rate can be also controlled by adjusting a die clearance and changing a contact area of the die with the steel sheet.

Examples of the method of increasing the cooling rate at around 400° C. and below include the following three kinds.

(a) Immediately after reaching 400° C., the steel sheet is moved to a die different in heat capacity or a die at room temperature.

(b) A water-cooling die is used and the water flow rate through the die is increased immediately after reaching 400° C.

(c) Immediately after reaching 400° C., water is passed between the die and the steel sheet. In this method, the cooling rate may be further increased by increasing the quantity of water according to temperature.

The mode of the forming in the hot pressing in the embodiment is not particularly limited. Examples of the mode of the forming include bending, drawing, bulging, hole expansion, and flanging. The mode of the forming may be appropriately selected depending on the kind of a target steel sheet member. Representative examples of the steel sheet member include a door guard bar, a bumper reinforcement and the like which are automobile reinforcing components. The hot forming is not limited to the hot pressing as long as the steel sheet can be cooled simultaneously with forming or immediately after forming. For example, roll forming may be performed as the hot forming.

Such a series of treatments are performed on the above-described steel sheet for hot pressing, thereby the steel sheet member according to the embodiment can be manufactured. In other words, it is possible to obtain a hot-pressed steel sheet member having a desired steel structure, a tensile strength of 980 MPa or more, and excellent ductility and bendability.

For example, the ductility can be evaluated by a total elongation (EL) in a tensile test, and the total elongation in the tensile test is preferably 12% or more in the embodiment. The total elongation is more preferably 14% or more. For example, the bendability can be evaluated by a limit bending radius in a V-bending test with a tip angle of 90°, and when the thickness of the hot-pressed steel sheet member is represented as t, the limit bending radius is preferably 5×t or less in the embodiment.

After the hot pressing and cooling, shot blasting may be performed. By the shot blasting, scale can be removed. The shot blasting also has an effect of introducing a compressive stress into the surface of the steel sheet member, and therefore effects of suppressing delayed fracture and improving a fatigue strength can be also obtained.

In the above-described method of manufacturing the steel sheet member, the hot pressing is not accompanied by preforming, the steel sheet for hot pressing is heated to the temperature zone of 720° C. to the $Ac_3$ point to cause austenite transformation to some extent, and then is formed. Thus, the mechanical properties of the steel sheet for hot pressing at room temperature before heating are not important.

The steel sheet member according to the embodiment can also be manufactured by going through hot pressing with preforming. For example, in a range where the above-described conditions of the heating, the decarburization treatment, and the cooling are satisfied, the hot-pressed steel sheet member may be manufactured by preforming by press working of the steel sheet for hot pressing using a die in a specific shape, putting it into the same type of die, applying a pressing force thereto, and rapidly cooling it. Also in this case, the kind of the steel sheet for hot pressing and its steel structure are not limited, but it preferable to use a steel sheet that has a strength as low as possible and has ductility. For example, the tensile strength is preferably 700 MPa or less.

It should be noted that the above-described embodiment merely illustrates a concrete example of implementing the present invention, and the technical scope of the present invention is not to be construed in a restrictive manner by the embodiment. That is, the present invention may be implemented in various forms without departing from the technical spirit or main features thereof.

Example

Next, the experiment performed by the inventor of the present application will be described. In this experiment, first, 19 kinds of steel materials having chemical compositions listed in Table 1 were used to fabricate 28 kinds of steel sheets for hot pressing (steel sheets to be subjected to a heat treatment) having steel structures listed in Table 2. The balance of each steel material was Fe and impurities. Each thickness of the steel sheets to be subjected to a heat treatment was 2.0 mm. In Table 2, "FULL HARD" indicates a full-hard steel sheet, and "PLATED STEEL SHEET" indicates a hot-dip galvanized cold-rolled steel sheet with a coating weight per one side of 60 g/m$^2$. The full-hard steel sheet used for this experiment is a steel sheet obtained by cold rolling a hot-rolled steel sheet having a thickness of 3.6 mm, in which annealing is not performed after cold rolling. In Table 2, each numerical value (unit: %) in the column of "FERRITE AREA RATIO" indicates an area ratio of ferrite in a region ranging from the surface of the steel sheet to 100 μm in depth. Further, in Table 2, each numerical value (unit: %) in the column of "PEARLITE AREA RATIO" indicates an area ratio of pearlite having an average grain diameter of 5 μm or more in a region excluding the region ranging from the surface to 100 μm in depth. These area ratios each are an average value of values calculated by performing an image analysis of electron microscope observation images of two cross sections: a cross section perpendicular to the rolling direction; and a cross section perpendicular to the sheet width direction (direction perpendicular to the rolling direction).

After the fabrication of the steel sheets to be subjected to a heat treatment, the steel sheets were heated in a gas heating furnace with an air-fuel ratio of 0.9 under conditions listed in Table 2. In Table 2, "HEATING TIME" indicates a time period from when the steel sheet is charged into the gas heating furnace and then the temperature of the steel sheet reaches 720° C. to when the steel sheet is taken out of the gas heating furnace. Further, in Table 2, "HEATING TEMPERATURE" indicates not the temperature of the steel sheet but the temperature inside the gas heating furnace. Then, the steel sheet was taken out of the gas heating furnace, a decarburization treatment of the steel sheet by air cooling was performed, hot pressing of the steel sheet was performed after the decarburization treatment, and the steel sheet was cooled after the hot pressing. In the hot pressing, a flat die made of steel was used. That is, forming was not performed. In the decarburization treatment, air cooling was performed while the steel sheet was taken out of the gas heating furnace to be put in the die, and the air cooling time was adjusted. When cooling the steel sheet, the steel sheet was cooled down to 150° C. being the Ms point or less at an average cooling rate listed in Table 2 with leaving the steel sheet in contact with the die, and then the steel sheet was taken out of the die to let the steel sheet cool. When cooling down to 150° C., the periphery of the die was cooled by cooling water until the temperature of the steel sheet became 150° C., or a die adjusted to the normal temperature was prepared, and then the steel sheet was held in the die until the temperature of the steel sheet became 150° C. In a measurement of the average cooling rate down to 150° C., a thermocouple was attached to the steel sheet in advance, and temperature history of the steel sheet was analyzed. In this manner, 28 kinds of sample materials (sample steel sheets) were fabricated. The sample material (sample steel sheet) is sometimes referred to as a "hot-pressed steel sheet" below.

TABLE 1

| STEEL MATERIAL SYMBOL | COMPONENT (MASS %) | | | | | | | | | |
|---|---|---|---|---|---|---|---|---|---|---|
| | C | Si | Mn | P | S | sol. Al | N | Ti | Nb | V |
| A | 0.202 | 0.23 | 1.56 | 0.014 | 0.0012 | 0.042 | 0.0045 | — | — | — |
| B | 0.197 | 1.20 | 1.16 | 0.014 | 0.0012 | 0.036 | 0.0042 | — | — | — |
| C | 0.180 | 0.82 | 1.78 | 0.013 | 0.0011 | 0.029 | 0.0042 | — | — | — |
| D | 0.154 | 1.23 | 1.59 | 0.011 | 0.0011 | 0.029 | 0.0045 | — | — | — |
| E | 0.162 | 1.25 | 2.38 | 0.012 | 0.0009 | 0.030 | 0.0046 | — | — | — |
| F | 0.124 | 1.33 | 2.02 | 0.014 | 0.0014 | 0.033 | 0.0042 | — | — | 0.03 |
| G | 0.199 | 1.21 | 1.24 | 0.012 | 0.0010 | 0.027 | 0.0043 | — | — | — |
| H | 0.159 | 1.19 | 2.03 | 0.011 | 0.0014 | 0.032 | 0.0043 | — | — | — |
| I | 0.158 | 1.22 | 2.37 | 0.009 | 0.0013 | 0.034 | 0.0047 | — | — | — |
| J | 0.150 | 1.18 | 0.81 | 0.011 | 0.0014 | 0.029 | 0.0043 | — | — | — |
| K | 0.154 | 1.24 | 1.51 | 0.010 | 0.0012 | 0.041 | 0.0044 | 0.07 | 0.05 | — |
| L | 0.153 | 1.21 | 1.62 | 0.009 | 0.0012 | 0.032 | 0.0045 | — | — | — |
| M | 0.083 | 1.03 | 1.54 | 0.013 | 0.0011 | 0.036 | 0.0048 | — | — | — |
| N | 0.161 | 1.18 | 2.44 | 0.012 | 0.0009 | 0.031 | 0.0042 | — | — | — |
| O | 0.150 | 1.22 | 1.98 | 0.013 | 0.0012 | 0.035 | 0.0041 | — | — | — |
| P | 0.110 | 1.78 | 3.11 | 0.011 | 0.0015 | 0.039 | 0.0039 | — | — | — |
| Q | 0.201 | 1.23 | 1.62 | 0.008 | 0.0011 | 0.038 | 0.0038 | — | — | — |
| R | 0.153 | 1.23 | 2.13 | 0.011 | 0.0013 | 0.037 | 0.0040 | — | — | — |
| S | 0.465 | 1.22 | 2.02 | 0.011 | 0.0012 | 0.035 | 0.0041 | — | — | — |

| STEEL MATERIAL SYMBOL | COMPONENT (MASS %) | | | | | | | | | | Ac3 |
|---|---|---|---|---|---|---|---|---|---|---|---|
| | Cr | Mo | Cu | Ni | Ca | Mg | REM | Zr | B | Bi | (° C.) |
| A | — | — | — | — | — | — | — | — | — | — | 809 |
| B | — | — | — | — | — | — | — | — | — | — | 863 |
| C | 0.3 | — | — | — | — | — | — | — | — | — | 825 |
| D | — | — | — | — | — | — | — | 0.002 | — | — | 857 |
| E | — | — | — | — | — | — | 0.002 | — | — | 0.001 | 833 |
| F | — | — | — | — | — | — | — | — | — | — | 863 |
| G | — | 0.1 | — | — | — | — | — | — | — | — | 859 |
| H | — | — | — | — | — | — | — | — | — | — | 842 |
| I | — | — | 0.1 | 0.1 | 0.002 | — | — | — | — | — | 829 |
| J | — | — | — | — | — | — | — | — | — | — | 879 |
| K | — | — | — | — | — | — | — | — | — | — | 867 |
| L | — | — | — | — | — | — | — | — | — | — | 855 |
| M | — | — | — | — | — | — | — | — | — | — | 875 |
| N | — | — | — | — | — | — | 0.002 | — | — | — | 829 |
| O | — | — | — | — | — | 0.002 | — | — | — | — | 850 |
| P | — | — | — | — | — | — | — | — | — | — | 852 |
| Q | — | — | — | — | — | — | — | — | — | — | 846 |
| R | — | — | — | — | — | — | — | — | 0.001 | — | 844 |
| S | — | — | — | — | — | — | — | — | — | — | 787 |

UNDERLINE INDICATES THAT VALUE IS OUTSIDE THE RANGE OF THE PRESENT INVENTION

TABLE 2

| SAMPLE MATERIAL No. | STEEL MATERIAL SYMBOL | STEEL SHEET SUBJECTED TO HEAT TREATMENT: TYPE | FERRITE AREA RATIO (%) | PEARLITE AREA RATIO (%) | THICKNESS OF INTERNAL OXIDE LAYER (μm) | HEATING CONDITION: HEATING RATE (° C./SEC) ROOM TEMPERATURE TO 600° C. | HEATING RATE (° C./SEC) 600° C.~720° C. | HEATING TEMPERATURE (° C.) | HEATING TIME (MIN) | DECARBURIZATION TREATMENT: AIR COOLING TIME (SEC) | DECARBURIZED AMOUNT (%) | COOLING AFTER HOT PRESSING AVERAGE COOLING RATE (° C./SEC) |
|---|---|---|---|---|---|---|---|---|---|---|---|---|
| 1 | A | FULL HARD | 78 | 18 | 3 | 19 | 8 | 750 | 6 | 9 | 0.004 | 70 |
| 2 | B | COLD-ROLLED STEEL SHEET | 75 | 17 | 2 | 19 | 8 | 800 | 7 | 9 | 0.003 | 70 |
| 3 | B | FULL HARD | 73 | 16 | 3 | 19 | 8 | 800 | 7 | 60 | 0.017 | 70 |
| 4 | B | FULL HARD | 79 | 17 | 2 | 19 | 8 | 820 | 3 | 2 | 0 | 70 |
| 5 | B | COLD-ROLLED STEEL SHEET | 78 | 8 | 3 | 19 | 8 | 790 | 7 | 9 | 0.004 | 70 |
| 6 | C | PLATED STEEL SHEET | 80 | 17 | 0 | 19 | 8 | 760 | 6 | 9 | 0.004 | 70 |
| 7 | C | HOT-ROLLED STEEL SHEET | 92 | 16 | 3 | 19 | 8 | 760 | 3 | 9 | 0.004 | 70 |
| 8 | D | FULL HARD | 76 | 15 | 5 | 19 | 8 | 830 | 5 | 9 | 0.002 | 70 |
| 9 | E | FULL HARD | 78 | 14 | 5 | 19 | 8 | 750 | 6 | 9 | 0.003 | 70 |
| 10 | F | HOT-ROLLED STEEL SHEET | 76 | 17 | 14 | 19 | 8 | 800 | 8 | 9 | 0.002 | 70 |
| 11 | F | HOT-ROLLED STEEL SHEET | 79 | 12 | 32 | 19 | 8 | 800 | 8 | 9 | 0.002 | 70 |
| 12 | G | FULL HARD | 72 | 16 | 5 | 19 | 8 | 800 | 7 | 9 | 0.004 | 70 |
| 13 | H | FULL HARD | 74 | 14 | 8 | 19 | 8 | 800 | 7 | 9 | 0.002 | 70 |
| 14 | I | COLD-ROLLED STEEL SHEET | 76 | 17 | 1 | 19 | 8 | 800 | 7 | 9 | 0.001 | 70 |
| 15 | J | FULL HARD | 72 | 13 | 4 | 19 | 8 | 750 | 5 | 9 | 0.003 | 70 |
| 16 | K | FULL HARD | 73 | 13 | 3 | 19 | 8 | 800 | 6 | 9 | 0.003 | 70 |
| 17 | L | PLATED STEEL SHEET | 70 | 18 | 2 | 19 | 8 | 700 | 6 | 9 | 0.004 | 70 |
| 18 | L | COLD-ROLLED STEEL SHEET | 72 | 15 | 2 | 19 | 8 | 800 | 6 | 9 | 0.002 | 70 |
| 19 | L | FULL HARD | 25 | 12 | 2 | 19 | 8 | 800 | 4 | 9 | 0.004 | 70 |
| 20 | L | FULL HARD | 75 | 14 | 1 | 19 | 8 | 800 | 6 | 9 | 0.003 | 5 |
| 21 | M | COLD-ROLLED STEEL SHEET | 83 | 11 | 0 | 19 | 8 | 800 | 7 | 9 | 0.001 | 70 |
| 22 | N | FULL HARD | 76 | 14 | 2 | 19 | 8 | 750 | 6 | 9 | 0.003 | 70 |
| 23 | O | FULL HARD | 72 | 12 | 3 | 19 | 8 | 800 | 4 | 9 | 0.002 | 70 |
| 24 | O | FULL HARD | 76 | 13 | 4 | 19 | 8 | 900 | 8 | 9 | 0.002 | 70 |
| 25 | P | FULL HARD | 81 | 11 | 2 | 19 | 8 | 800 | 7 | 9 | 0.001 | 70 |
| 26 | Q | PLATED STEEL SHEET | 75 | 18 | 5 | 19 | 8 | 800 | 6 | 9 | 0.002 | 70 |
| 27 | R | FULL HARD | 78 | 14 | 4 | 19 | 8 | 800 | 7 | 9 | 0.001 | 70 |
| 28 | S | HOT-ROLLED STEEL SHEET | 25 | 75 | 0 | 19 | 8 | 780 | 7 | 9 | 0.003 | 70 |

UNDERLINE INDICATES THAT VALUE IS OUTSIDE THE RANGE OF THE PRESENT INVENTION

After the hot-pressed steel sheets were obtained, regarding each of these steel sheets, an area ratio of ferrite in the surface layer portion, an area ratio of ferrite in the inner layer portion, and an area ratio of martensite in the inner layer portion were found. These area ratios each are an average value of values calculated by performing an image analysis of electron microscope observation images of two cross sections: a cross section perpendicular to the rolling direction; and a cross section perpendicular to the sheet width direction (direction perpendicular to the rolling direction). In an observation of the steel structure of the surface layer portion, the region ranging from the surface of the steel sheet to 15 μm in depth was observed. In an observation of the steel structure of the inner layer portion, it was observed at the ¼ depth position. In Table 3, the ratio of the area ratio of ferrite in the surface layer portion to the area ratio of ferrite in the inner layer portion, and the area ratio of ferrite and the area ratio of martensite in the inner layer portion are listed.

The mechanical properties of the hot-pressed steel sheets were also examined. In this examination, measurements of a tensile strength (TS) and a total elongation (EL), and evaluation of bendability were performed. In the measurements of the tensile strength and the total elongation, a JIS No. 5 tensile test piece was taken from each of the steel sheets in a direction perpendicular to the rolling direction to be subjected to a tensile test. In the evaluation of bendability, a test piece (30 mm×60 mm) was taken from each of the steel sheets so that a bending edge line was positioned in the rolling direction to be subjected to a V-bending test with a tip angle of 90° and a tip radius of 10 mm. Then, the surface of a bent portion after the test was visually observed, and the case where no cracks were recognized was regarded as good and the case where cracks were recognized was regarded as poor. These examination results are also listed in Table 3. Regarding each of the hot-pressed steel sheets, hot pressing using a flat die made of steel was performed, but forming was not performed at the time of hot pressing. However, the mechanical properties of each of these hot-pressed steel sheets reflect mechanical properties of the hot-pressed steel sheet member fabricated by being subjected to the same thermal history as that of the hot pressing in this experiment at the time of forming. That is, as long as the thermal history is substantially the same regardless of whether or not forming is performed at the time of hot pressing, the mechanical properties thereafter become substantially the same.

TABLE 3

| SAMPLE MATERIAL No. | STEEL MATERIAL SYMBOL | RATIO BETWEEN FERRITE AREA RATIOS (SURFACE LAYER PORTION/ INNER LAYER PORTION) | STEEL STRUCTURE OF INNER LAYER PORTION FERRITE AREA RATIO (%) | MARTENSITE AREA RATIO (%) | TS (MPa) | EL (%) | BENDABILITY | NOTE |
|---|---|---|---|---|---|---|---|---|
| 1 | A | 1.35 | 65 | 35 | 1022 | 10.6 | GOOD | COMPARATIVE EXAMPLE |
| 2 | B | 1.58 | 59 | 41 | 1043 | 14.5 | GOOD | INVENTION EXAMPLE |
| 3 | B | 1.47 | 68 | 18 | 843 | 24.8 | GOOD | COMPARATIVE EXAMPLE |
| 4 | B | 1.13 | 53 | 47 | 1108 | 12.5 | POOR | COMPARATIVE EXAMPLE |
| 5 | B | 1.24 | 76 | 23 | 964 | 18.3 | GOOD | COMPARATIVE EXAMPLE |
| 6 | C | 1.28 | 64 | 36 | 1019 | 12.9 | GOOD | INVENTION EXAMPLE |
| 7 | C | 1.32 | 74 | 26 | 952 | 13.9 | GOOD | COMPARATIVE EXAMPLE |
| 8 | D | 1.98 | 44 | 56 | 1188 | 13.0 | GOOD | INVENTION EXAMPLE |
| 9 | E | 1.24 | 68 | 32 | 1009 | 13.1 | GOOD | INVENTION EXAMPLE |
| 10 | F | 1.77 | 48 | 52 | 1245 | 13.1 | GOOD | INVENTION EXAMPLE |
| 11 | F | 1.94 | 51 | 49 | 1189 | 12.2 | POOR | COMPARATIVE EXAMPLE |
| 12 | G | 1.36 | 66 | 34 | 1118 | 15.2 | GOOD | INVENTION EXAMPLE |
| 13 | H | 1.96 | 45 | 55 | 1279 | 12.9 | GOOD | INVENTION EXAMPLE |
| 14 | I | 2.69 | 35 | 65 | 1281 | 13.0 | GOOD | INVENTION EXAMPLE |
| 15 | J | 1.30 | 69 | 21 | 886 | 23.8 | GOOD | COMPARATIVE EXAMPLE |
| 16 | K | 1.48 | 64 | 36 | 1022 | 13.0 | GOOD | INVENTION EXAMPLE |
| 17 | L | 1.02 | 96 | 0 | 591 | 33.1 | GOOD | COMPARATIVE EXAMPLE |
| 18 | L | 1.56 | 64 | 36 | 1138 | 15.9 | GOOD | INVENTION EXAMPLE |
| 19 | L | 1.07 | 60 | 40 | 1157 | 15.3 | POOR | COMPARATIVE EXAMPLE |
| 20 | L | 1.47 | 60 | 20 | 794 | 24.1 | GOOD | COMPARATIVE EXAMPLE |
| 21 | M | 1.40 | 68 | 32 | 943 | 15.8 | GOOD | COMPARATIVE EXAMPLE |
| 22 | N | 1.31 | 68 | 32 | 1028 | 12.9 | GOOD | INVENTION EXAMPLE |
| 23 | O | 2.04 | 46 | 54 | 1209 | 15.4 | GOOD | INVENTION EXAMPLE |
| 24 | O | CALCULATION IMPOSSIBLE | 0 | 100 | 1492 | 6.8 | GOOD | COMPARATIVE EXAMPLE |
| 25 | P | 2.24 | 38 | 62 | 1195 | 13.1 | POOR | COMPARATIVE EXAMPLE |
| 26 | Q | 2.34 | 38 | 62 | 1284 | 13.4 | GOOD | INVENTION EXAMPLE |
| 27 | R | 2.59 | 37 | 63 | 1290 | 13.4 | GOOD | INVENTION EXAMPLE |
| 28 | S | 4.21 | 5 | 95 | 1890 | 5.6 | POOR | COMPARATIVE EXAMPLE |

UNDERLINE INDICATES THAT VALUE IS OUTSIDE THE RANGE OF THE PRESENT INVENTION

As listed in Table 3, the sample materials No. 2, No. 6, No. 8 to No. 10, No. 12 to No. 14, No. 16, No. 18, No. 22, No. 23, No. 26, and No. 27 each being an invention example exhibited excellent ductility and bendability. This reveals that even if the steel sheet for hot pressing is any one of a full-hard steel sheet, a cold-rolled steel sheet, a hot-rolled steel sheet, and a hot-dip galvanized cold-rolled steel sheet, the present invention exhibits excellent effects.

On the other hand, the sample material No. 1 was poor in ductility because the chemical composition was outside the range of the present invention. The sample materials No. 3, No. 17, and No. 20 were not able to obtain a tensile strength of 980 MPa or more after cooling (after annealing) because the manufacturing condition was outside the range of the present invention and the steel structure after hot pressing was also outside the range of the present invention. The sample material No. 4 was poor in bendability because the manufacturing condition was outside the range of the present invention and the steel structure after hot pressing was also outside the range of the present invention. The sample material No. 5 and the sample material No. 7 were not able to obtain a tensile strength of 980 MPa or more after cooling because the steel structure of the steel sheet subjected to a heat treatment was outside the range of the present invention and the steel structure after hot pressing was also outside the range of the present invention. The sample material No. 11 was poor in bendability because the steel structure of the steel sheet subjected to a heat treatment was outside the range of the present invention. The sample material No. 19 was poor in bendability because the steel structure of the steel sheet subjected to a heat treatment was outside the range of the present invention and the steel structure after hot pressing was also outside the range of the present invention. The sample materials No. 15 and No. 21 were not able to obtain a tensile strength of 980 MPa or more after cooling (after annealing) because the chemical composition was outside the range of the present invention. The sample material No. 24 was poor in ductility because the manufacturing condition was outside the range of the present invention and the steel structure after hot pressing was also outside the range of the present invention. The sample material No. 25 was poor in bendability because the chemical composition was outside the range of the present invention. The sample material No. 28 was poor in ductility because the chemical composition was outside the range of the present invention and the steel structure after hot pressing was also outside the range of the present invention.

In the sample material No. 17 being a comparative example, the bendability was good even though the ratio of the area ratio of ferrite in the surface layer portion to the area ratio of ferrite in the inner layer portion was less than 1.20, and this is because the tensile strength (TS) was 591 MPa, which was extremely low.

INDUSTRIAL APPLICABILITY

The present invention may be used for, for example, industries of manufacturing and using automobile body structural components and so on in which importance is placed on excellent collision characteristic. The present invention may be used also for industries of manufacturing and using other machine structural components, and so on.

The invention claimed is:

1. A hot-pressed steel sheet member, comprising:

a chemical composition represented by, in mass %:

C: 0.10% to 0.34%;
Si: 0.5% to 2.0%;
Mn: 1.0% to 3.0%;
sol. Al: 0.001% to 1.0%;
P: 0.05% or less;
S: 0.01% or less;
N: 0.01% or less;
Ti: 0% to 0.20%;
Nb: 0% to 0.20%;
V: 0% to 0.20%;
Cr: 0% to 1.0%;
Mo: 0% to 1.0%;
Cu: 0% to 1.0%;
Ni: 0% to 1.0%;
Ca: 0% to 0.01%;
Mg: 0% to 0.01%;
REM: 0% to 0.01%;
Zr: 0% to 0.01%;
B: 0% to 0.01%;
Bi: 0% to 0.01%; and
balance: Fe and impurities; and a steel structure in which:

an area ratio of ferrite in a surface layer portion ranging from a surface to 15 μm in depth is greater than 1.20 times an area ratio of ferrite in an inner layer portion being a portion excluding the surface layer portion starting at a depth greater than 15 μm; and the inner layer portion comprises a steel structure represented, in area %:

ferrite: 10% to 70%;
martensite: 30% to 90%; and
a total area ratio of ferrite and martensite: 90% to 100%, wherein a tensile strength of the hot-pressed steel sheet member is 980 MPa or more.

2. The hot-pressed steel sheet member according to claim 1, wherein the chemical composition comprises one or more selected from the group consisting of, in mass %:

Ti: 0.003% to 0.20%;
Nb: 0.003% to 0.20%;
V: 0.003% to 0.20%;
Cr: 0.005% to 1.0%;
Mo: 0.005% to 1.0%;
Cu: 0.005% to 1.0%; and
Ni: 0.005% to 1.0%.

3. The hot-pressed steel sheet member according to claim 1, wherein the chemical composition comprises one or more selected from the group consisting of, in mass %:

Ca: 0.0003% to 0.01%;
Mg: 0.0003% to 0.01%;
REM: 0.0003% to 0.01%; and
Zr: 0.0003% to 0.01%.

4. The hot-pressed steel sheet member according to claim 1, wherein the chemical composition comprises, in mass %, B: 0.0003% to 0.01%.

5. The hot-pressed steel sheet member according to claim 1, wherein the chemical composition comprises, in mass %, Bi: 0.0003% to 0.01%.

* * * * *